United States Patent [19]

Laimer

[11] 4,200,263

[45] Apr. 29, 1980

[54] FILLING STAND ARRANGEMENT FOR A METALLURGICAL LADLE

[75] Inventor: Friedrich Laimer, Kerngraben, Austria

[73] Assignee: Voest-Alpine Aktiengesellschaft, Linz, Austria

[21] Appl. No.: 895,643

[22] Filed: Apr. 12, 1978

[30] Foreign Application Priority Data

Apr. 22, 1977 [AT] Austria ..... 2831/77

[51] Int. Cl.[2] ..... C21C 5/40

[52] U.S. Cl. ..... 266/142; 266/158

[58] Field of Search ..... 266/142, 143, 158, 165; 75/60

[56] References Cited

U.S. PATENT DOCUMENTS

| | | | |
|---|---|---|---|
| 3,604,697 | 9/1971 | Kawana et al. | 266/158 |
| 3,913,898 | 10/1975 | Wolters | 266/142 |
| 4,031,819 | 6/1977 | Applewhite | 266/158 |

FOREIGN PATENT DOCUMENTS

| | | | |
|---|---|---|---|
| 5124505 | 2/1976 | Japan | 166/158 |
| 6917264 | 5/1971 | Netherlands | 266/165 |
| 255527 | 10/1968 | U.S.S.R. | 266/158 |

*Primary Examiner*—Paul A. Bell

*Attorney, Agent, or Firm*—Brumbaugh, Graves, Donohue & Raymond

[57] ABSTRACT

A filling stand arrangement for a metallurgical ladle with a ladle mouth, has at least one delivery device for molten metal and a hood covering the mouth of the metallurgical ladle, which hood has at least one recess for pouring in the molten metal. An exhaust conduit means, to which the hood is connected, is provided along with a flue dome located above the at least one delivery device. The flue dome is also connected to the exhaust conduit means and covers the delivery device and the at least one recess of the hood.

5 Claims, 2 Drawing Figures

FILLING STAND ARRANGEMENT FOR A METALLURGICAL LADLE

BACKGROUND OF THE INVENTION

The invention relates to a filling stand for metallurgical ladles, having at least one delivery device for molten metal advantageously designed as a movable and tiltable submarine mixer, and a hood covering the mouth of a ladle moved to the filling stand. The hood has at least one recess for pouring in the metal and is connected to an exhaust conduit.

When pouring molten metal, for instance pig iron or steel, from a submarine mixer into a ladle, intensive smoke and flue gases will be created.

For diverting these gases and the smoke, it has been known to cover the ladle with a hood. The hood, on its upper side, has a recess for pouring in the metal and is provided with a laterally connected exhaust conduit. The flue gases escaping from the delivery device, particularly at the onset on pouring, can freely rise within the hall, thus negatively affecting the environment. A further disadvantage of the known installation is that during rapid pouring, a gushing out of smoke and flue gases from the pouring-in recess of the hood and the ladle at its connection with the hood, will be caused.

SUMMARY OF THE INVENTION

The invention aims at avoiding these disadvantages and difficulties and has as its object to provide a filling stand of the initially-described kind in which the flue gases both escaping from the delivery device and gushing out of the ladle and the hood, can be totally seized and controllably conducted away from the filling stand.

This object is achieved according to the invention in that a flue dome is connected to an exhaust conduit and is provided above the pouring position of the delivery device(s) such that it covers the delivery device(s) and the pouring-in recess(es) of the hood.

According to a preferred embodiment the hood comprises a hood section tapering up from the ladle and entering into a vertically directed pipe-like hood section which, on its upper end, is connected to an exhaust conduit. The recess(es) for pouring in metal are designed as slot(s) penetrating the side walls of the hood, through which recess(es) a discharge lip of the submarine mixer can be pivoted. By this means the gushing out of flue gases off from the hood is reduced and the flue dome is kept considerably free from flue gases coming from the ladle, so that the actual pouring process can be observed better.

Advantageously, the exhaust conduit of the flue dome is centrally penetrated by the exhaust conduit of the hood, flue gases being thus seizable from all sides of the hood.

Suitably, the exhaust conduit of the flue dome and the exhaust conduit of the hood each comprise a controlling device for adjusting the sucking performance, which controlling devices are connected to a common exhaust means.

BRIEF DESCRIPTION OF THE DRAWINGS

The invention shall be explained in more detail by way of one embodiment and with reference to the accompanying drawings, wherein.

DESCRIPTION OF AN EXEMPLARY EMBODIMENT

Figure 1:
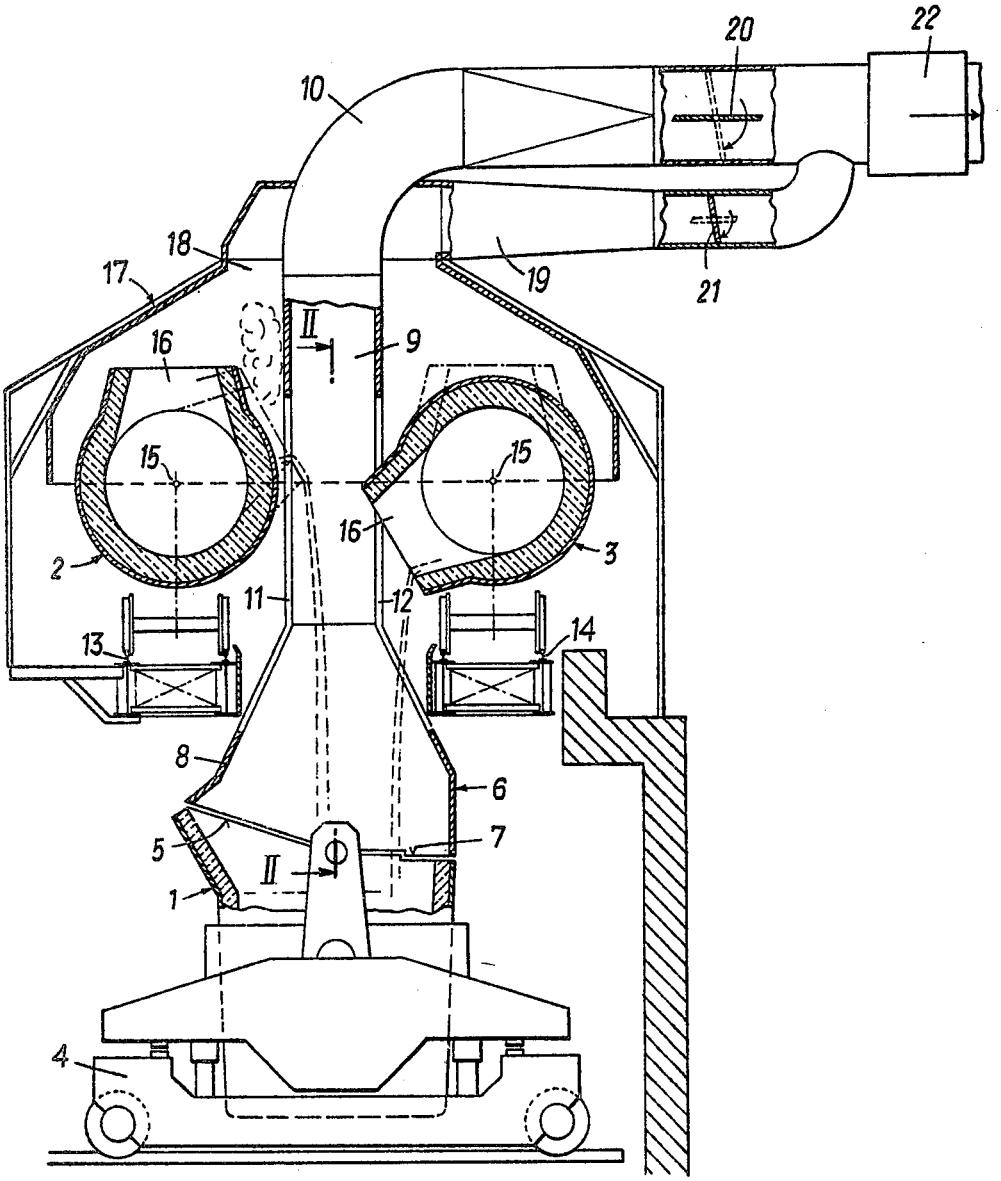
FIG. 1 shows a vertical section of a filling stand according to the present invention.
Figure 2:
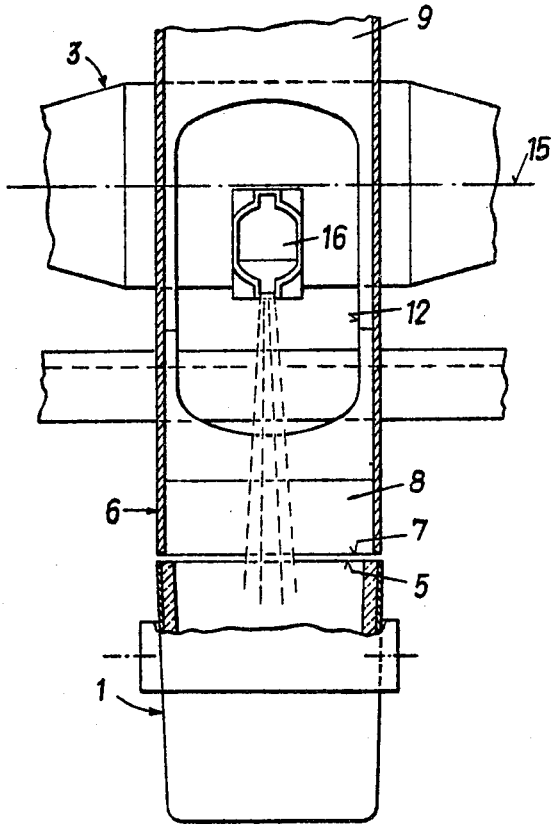
FIG. 2 shows a section along line II—II of FIG. 1.

A ladle 1 has pig iron poured into it, which pig iron is taken to a filling stand by means of two delivery devices designed as submarine mixers 2, 3. The ladle 1 is placed on a ladle car 4 and is displaceable with th same.

The mouth 5 of the ladle is covered by a hood 6 that is lined with haematite or fireclay and whose lower end 7 matches the contour of the ladle mouth 5. The lower part 8 of the hood tapers up into a pipe-like hood section 9 having a rectangular cross section and being vertically directed. An exhaust conduit 10 is connected to the upper end of the hood section 9. From the tapering section 8 of the hood, two slot-like recesses 11 and 12, opposing each other, extend into the pipe-like section serve as pouring-in openings for pouring the molten pig iron into the ladle.

Above the ladle 1 the two displaceable submarine mixers 2 and 3 can be moved on rails 13, 14 to the recesses in the side walls of the hood, on both sides of the pipe-like hood section 9. The submarine mixers are tiltable about their longitudinal axes 15, the discharge lip 16 of each submarine mixer 2, 3 thus being pivotable into the respective pouring-in recess 11, 12, so that the pig iron can get into the ladle 1 via the recesses 11, 12.

Above the pouring-in position of the submarine mixers 2, 3 a flue dome 17 covering the submarine mixers and the pouring-in recesses 11, 12 is arranged, which dome also tapers up like a funnel and, at its upmost end 18, is connected to an exhaust conduit 19. The conduit 10 of the hood 6 centrally penetrates the exhaust conduit 19 of the flue dome 17, so that the total of flue gases rising up to the flue dome 17 can be safely seized and conducted away.

The two exhaust conduits 10 and 19 include controlling devices 20, 21 which are separately adjustable, for adjusting the exhaust performance, which conduits meet subsequent to the controlling devices. An exhaust means, such as ventilator 22, serves for both conduits 10 and 19.

Pouring pig iron from the submarine mixers into the ladle is effected in the following way:

At first, the empty ladle 1 is moved to a position below the hood 6 by means of the ladle car 4. The submarine mixer then is positioned in such a way that its discharge lip 16 can pivot into the recess 11 of the hood 6. When moving the submarine mixer into the flue dome, its side walls arranged transversely to the rails 13, 14 can be opened, for instance by being swivelled. Particularly at the onset of pouring, smoke and flue gases emerge from the discharge lip 16, which, due to the initially slight tilting of the submarine mixer—this position is shown for the submarine mixer 2 in FIG. 1 in a dot-and-dash line—at first cannot be seized by the suction of the hood 6. These smoke and flue gases rise into the flue dome 17, are collected there and conducted away via its exhaust conduit 19, for instance to a filter not illustrated.

If, during rapid tilting of the submarine mixer, gushing of gases and smoke is caused between the ladle mouth 5 and the hood 6 or at one of the recesses 11, 12, these flue gases are also conducted away via the conduit 19 of the flue dome. The flue gases formed in the ladle 1 are conducted away to filter, via the exhaust conduit 10.

What I claim is:

1. In a filling stand arrangement for a metallurgical ladle having a ladle mouth and being movable to said filling stand arrangement, said filling stand arrangement including at least one delivery device for molten metal, a hood covering said ladle mouth and having at least one recess for pouring in said molten metal from said delivery device, and first exhaust conduit means connected directly to said hood, the improvement comprising a flue dome provided above said at least one delivery device when said delivery device is in its pouring position, said flue dome connected to said first exhaust conduit means via a second exhaust conduit means and completely covering said at least one recess provided in said hood and said at least one delivery device, said hood being positioned closely adjacent said ladle mouth and said recess being designed as a slot penetrating a side wall of said hood.

2. In a filling stand arrangement for a metallurgical ladle having a ladle mouth and being movable to said filling stand arrangement, said filling stand arrangement including at least one delivery device designed as at least one movable and tiltable submarine mixer for molten metal, a hood covering said ladle mouth and having at least one recess for pouring in said molten metal from said mixer, and exhaust conduit means connected to said hood, the improvement comprising a flue dome provided above said at least one mixer when said mixer is in its pouring position, said flue dome being connected to said exhaust conduit means and completely covering said at least one recess provided in said hood and said at least one mixer, said hood being positioned closely adjacent said ladle mouth and said recess being designed as a slot penetrating a side wall of said hood.

3. A filling stand arrangement as set forth in claim 2, wherein said hood includes a first hood section tapering upwards from said metallurgical ladle in a generally conical fashion, and a second hood section being designed as a vertically directed pipe connected, at its upper end, to said exhaust conduit means, said first hood section entering into said second hood section, said at least one recess being designed as at least one generally vertical slot penetrating a side wall of said hood, said at least one movable and tiltable submarine mixer having a discharge lip, said discharge lip being pivotable through said at least one slot.

4. In a filling stand arrangement for a metallurgical ladle having a ladle mouth and being movable to said filling stand arrangement, said filling stand arrangement including at least one delivery device for molten metal, a hood covering said ladle mouth and having at least one recess for pouring in said molten metal from said delivery device, and exhaust conduit means connected to said hood, the improvement comprising a flue dome provided above said at least one delivery device when said delivery device is in its pouring position and completely covering said at least one recess provided in said hood and said at least one delivery device, said hood being positioned closely adjacent said ladle mouth and said recess being designed as a slot penetrating a side wall of said hood, said exhaust conduit means including a first exhaust conduit connected to said hood and a second exhaust conduit connected to said flue dome, said first exhaust conduit centrally penetrating said second exhaust conduit.

5. A filling stand arrangement as set forth in claim 4, wherein said second exhaust conduit and said first exhaust conduit each include a controlling device for adjusting the respective sucking performance, a common exhaust means being provided to which exhaust means said second exhaust conduit and said first exhaust conduit are connected.

* * * * *